US008520880B2

(12) United States Patent
Akino

(10) Patent No.: US 8,520,880 B2
(45) Date of Patent: Aug. 27, 2013

(54) BOUNDARY MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 0 days.

(21) Appl. No.: 13/200,754

(22) Filed: Sep. 30, 2011

(65) Prior Publication Data

US 2012/0099752 A1 Apr. 26, 2012

(30) Foreign Application Priority Data

Oct. 25, 2010 (JP) ..... 2010-238309

(51) Int. Cl.
*H04R 11/04* (2006.01)

(52) U.S. Cl.
USPC ..... 381/369; 381/361; 381/355; 379/420.03; 379/433.03; 174/350

(58) Field of Classification Search
None
See application file for complete search history.

(56) References Cited

U.S. PATENT DOCUMENTS

| | | | | |
|---|---|---|---|---|
| 6,016,346 | A * | 1/2000 | Rittmueller et al. | 379/420.02 |
| 6,643,380 | B2 * | 11/2003 | Rodemer | 381/369 |
| 7,106,876 | B2 * | 9/2006 | Santiago | 381/369 |
| 2006/0104470 | A1 * | 5/2006 | Akino | 381/369 |

* cited by examiner

*Primary Examiner* — Duc Nguyen
*Assistant Examiner* — Taunya McCarty
(74) *Attorney, Agent, or Firm* — Manabu Kanesaka

(57) ABSTRACT

A boundary microphone is provided to effectively reduce noises caused by external electromagnetic waves by providing electrostatic shielding, including on the portion of lead wires from a microphone unit to a circuit board. The boundary microphone has a base plate, a cover, a circuit board, and a microphone unit mounted in the opening with a metallic holder. A shield pattern for electrostatically shielding inside of the recess with the base plate is formed on the circuit board. The holder is configured to include a cylindrical section into which a rear end side of the microphone unit is fitted, and a D-cut section in which a part of a circumferential surface and a base surface of a cylinder with a base integral with the cylindrical section are cut away in parallel to a board surface of the circuit board, and the lead wire is routed within the D-cut section.

5 Claims, 2 Drawing Sheets

BOUNDARY MICROPHONE

CROSS-REFERENCE TO RELATED APPLICATION

The present application is based on, and claims priority from, Japanese Application Serial Number JP2010-238309, filed Oct. 25, 2010, the disclosure of which is hereby incorporated by reference herein in its entirety.

TECHNICAL FIELD

The present invention relates to a boundary microphone, and in particular to a technique for reducing a noise caused by external electromagnetic waves.

BACKGROUND ART

A boundary microphone is a kind of microphone of a flat, low profile shape for use on a table, floor, or the like, and includes a base plate 10 and a cover 20 closing the base plate 10 as shown in FIG. 4.

The base plate 10, whose base surface 10*a* is flat, includes a recess 11 for mounting a circuit board and a column 12 for connecting the cover on the upper surface side, and is provided with a backwall 13 that has a microphone cable drawing hole 13*a* in the rear. In many cases, the base plate 10 as a whole is made of die-cast aluminum, for example.

Although not shown in detail, a punched plate (perforated metal) or a wire mesh material, which has a number of sound wave through holes, is used for the cover 20. The cover 20 is screwed down to the column 12 by a male screw 21 to form an inner space on the upper surface side of the base plate 10.

A circuit board 30 that has a sound signal output part 31 is mounted over the recess 11 of the base plate 10. Although not shown, the sound signal output part 31 includes an impedance converter such as a field effect transistor (FET), a tone control circuit, a filter circuit, and the like.

The circuit board 30 is provided with an opening 32 in a part of the circuit board, and a microphone unit 40 is disposed in the opening 32 with a holder 50. Typically, a unidirectional condenser microphone unit that has a front acoustic terminal 40*a* and a rear acoustic terminal 40*b* is used for the microphone unit 40.

The microphone cable drawing hole 13*a* on the backwall 13 is provided with a code bushing 14, through which a microphone cable 15 is drawn into the inner space and electrically connected to a terminal portion on the circuit board 30.

The base plate 10 and the cover 20 are in contact with each other and in a conductive state in terms of DC; however, they suffer from insufficient electrostatic shielding against considerably strong electromagnetic waves radiated from a mobile phone.

Therefore, when the mobile phone is used near the boundary microphone, a high frequency current caused by the electromagnetic waves may flow in the microphone and may be detected by a semiconductor device such as the FET mounted on the circuit board 30, causing a noise.

Therefore, the inventor has proposed in Japanese Patent No. 4471818 to orient the side of a component mounting surface 30*b* of the circuit board 30, on which the sound signal output part 31 is located, toward the recess 11 side. A shield pattern composed of a solid pattern of copper foil is formed on the upper surface (opposite to the component mounting surface) 30*a* side of the circuit board 30 so that the shield pattern and the base plate 10 together form a shield case for the recess 11.

Although this reduces noises caused by external electromagnetic waves to some extent, there still remain some problems to be solved.

Referring to FIG. 4, the microphone unit 40 is fitted and held in the holder 50 that, on the rear end side, consists of a metallic cylinder with a base and disposed in the opening 32 of the circuit board with the holder 50. Conventionally, lead wires 42, 42 attached to a terminal board 41 of the microphone unit 40 are drawn through a small hole 51 in the base surface of the holder 50 and soldered to a predetermined land section of the circuit board 30.

This configuration suffers from insufficient electrostatic shielding on the portions of the lead wires 42, 42 drawn out of the holder 50 and extending to the circuit board 30, and when electromagnetic waves are applied to the portions of lead wires, a high frequency current may flow in the recess 11, still causing a noise.

In addition, since the lead wires 42, 42 are of coated type, which makes it difficult to uniformly maintain the shape of wires, another problem is that frequencies of electromagnetic waves that cause noises and the levels of the noises are non-uniform.

Therefore, it is an object of the invention to improve a boundary microphone described in Japanese Patent No. 4471818 to effectively reduce noises caused by external electromagnetic waves by providing sufficient electrostatic shielding, including on the portions of lead wires from a microphone unit to a circuit board.

SUMMARY OF THE INVENTION

To solve the above problems, in a boundary microphone including: a base plate having a flat base surface and a recess for mounting a wiring board formed on an upper surface side, the base plate being flat and made of a metallic material; a cover having a number of sound wave through holes, the cover closing the upper surface side of the base plate; a circuit board mounted on the base plate so as to cover the recess, the circuit board having, in a part of the circuit board, an opening for mounting a microphone unit; and a microphone unit mounted in the opening with a metallic holder, wherein a sound signal output part is provided on an underside of the circuit board that faces the recess, a shield pattern for electrostatically shielding inside of the recess with the base plate is formed on an upper surface side of the circuit board, and an output terminal of the microphone unit is electrically connected to the sound signal output part through a lead wire, the present invention is characterized in that the holder includes a cylindrical section into which a rear end side of the microphone unit is fitted, and a D-cut section in which a part of a circumferential surface and a base surface of a cylinder with a base integral with the cylindrical section is cut away in parallel to a board surface of the circuit board, and the lead wire is routed within the D-cut section.

According to the invention, as a metallic holder for mounting the microphone unit in an opening formed on the circuit board, there is provided a holder including a cylindrical section into which a rear end side of the microphone unit is fitted, and a D-cut section in which a part of a circumferential surface and a base surface of a cylinder with a base integral with the cylindrical section is cut away in parallel to a board surface of the circuit board, and a lead wire from the microphone unit to the circuit board is routed within the D-cut section. This provides sufficient electrostatic shielding on the portion of a lead wire, and noises caused by external electromagnetic waves can efficiently be reduced.

According to a preferred aspect of the invention, the D-cut section is soldered to the ground pattern.

Preferably, an uncoated solder plated wire may be used for the lead wire, and the lead wire may be drawn to the underside of the circuit board through a through hole and soldered to the sound signal output part.

In addition, since an uncoated solder plated wire is used for the lead wire, it is easier to provide uniform wiring shapes. Therefore, even if a noise is generated, it is easy to address the noise in the design because the frequency that undergoes interference can be invariable.

DETAILED DESCRIPTION

Figure 3:
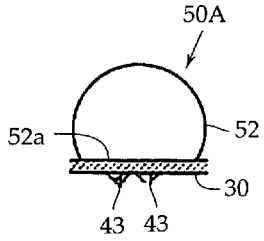
FIG. 3 is a side view showing the holder mounted on the circuit board.
Figure 4:
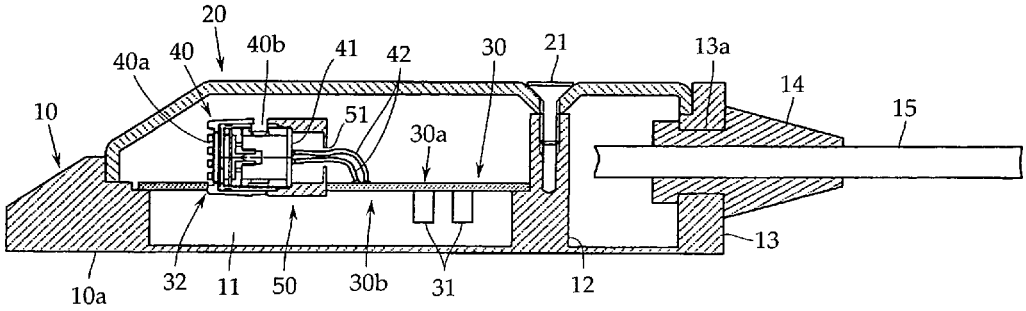
FIG. 4 Prior Art
FIG. 4 is a sectional view showing an inner structure of a prior art boundary microphone.

An embodiment of the invention will now be described with reference to FIGS. 1 to 3, although the present invention is not limited to the embodiment. In the description of the embodiment, like reference numerals are used to denote any components that do not require changes from the prior art in FIG. 4 as described above.

Figure 1:
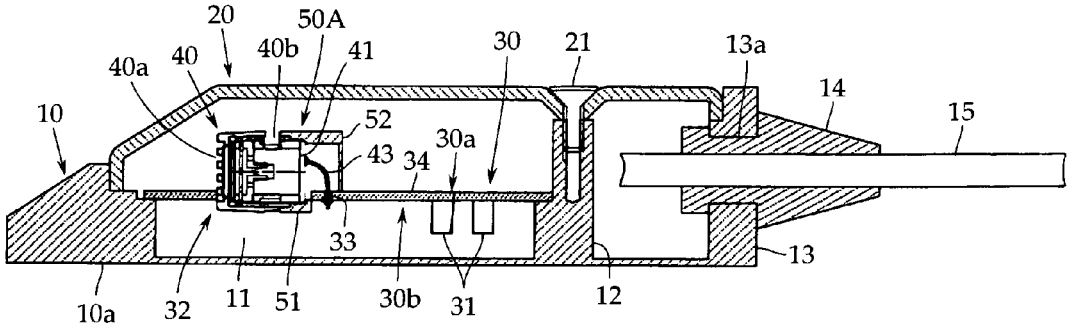
FIG. 1 is a sectional view showing an inner structure of a boundary microphone according to an embodiment of the invention.

As shown in FIG. 1, a boundary microphone according to the embodiment also includes a base plate 10 and a cover 20 closing the base plate 10, similarly to the prior art as described above.

The base plate 10, whose base surface 10*a* is formed flat so that the base plate 10 can be placed stably on a table top or a floor, includes a recess 11 for mounting a circuit board and a column 12 for connecting the cover on the upper surface side, and is provided with a backwall 13 that has a microphone cable drawing hole 13*a* in the rear. The base plate 10 may as a whole be made of die-cast aluminum, for example.

A punched plate (perforated metal) or a wire mesh material, which has a number of sound wave through holes, may be used for the cover 20. The cover 20 is screwed down to the column 12 by a male screw 21 to form an inner space on the upper surface side of the base plate 10.

A circuit board 30 that has a sound signal output part 31 is mounted over the recess 11 of the base plate 10. Although not shown, the sound signal output part 31 includes an impedance converter such as a field effect transistor (FET), a tone control circuit, and a filter circuit.

The circuit board 30 is provided with an opening 32 in a part of the circuit board, and a microphone unit 40 is mounted in the opening 32 with a holder 50A. In the embodiment, a unidirectional condenser microphone unit that has a front acoustic terminal 40*a* and a rear acoustic terminal 40*b* is used for the microphone unit 40.

The microphone cable drawing hole 13*a* on the backwall 13 is provided with a code bushing 14, through which a microphone cable 15 is drawn into the inner space and electrically connected to a terminal portion (not shown) on the circuit board 30. A two-core shielded wire is used for the microphone cable 15.

The base plate 10 and the cover 20 are in contact with each other and in a conductive state in terms of DC; however, they suffer from insufficient electrostatic shielding against considerably strong electromagnetic waves radiated from a mobile phone.

Figure 2:
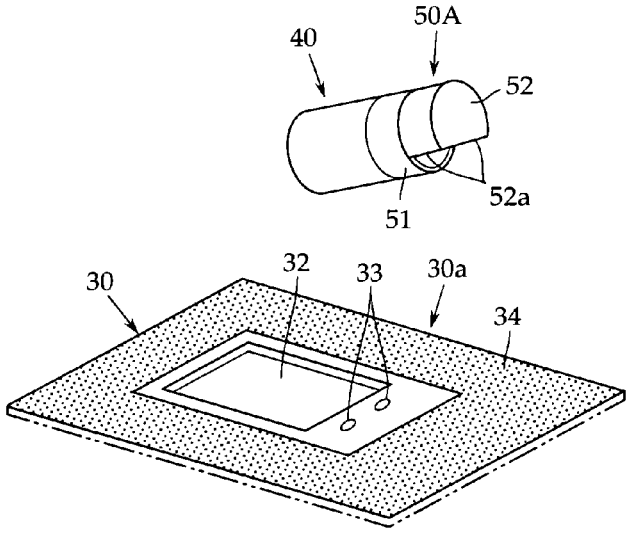
FIG. 2 is a perspective view showing a relationship between a holder, which is a prominent feature of the invention, and an opening of the circuit board.

In the present invention, therefore, in accordance with the invention described in Japanese Patent No. 4471818, the side of a component mounting surface 30*b* of the circuit board 30, on which the sound signal output part 31 is provided, is oriented toward the recess 11 side as the underside, and a shield pattern 34 composed of a solid pattern of copper foil is formed on the upper surface (opposite to the component mounting surface) 30*a* side of the circuit board 30, as shown in FIG. 2, so that the shield pattern 34 and the base plate 10 together form a shield case for the recess 11.

Although not shown, the shield pattern 34 is electrically connected to a shielded wire of the microphone cable 15 and/or the base plate 10 alone or in combination with a ground pattern on the component mounting surface 30*b* side.

Referring to both FIGS. 2 and 3, in the invention, a holder 50A configured as described below is used to electrostatically shield even a pair of lead wires 43, 43 routed between a terminal board 41 of the microphone unit 40 and the circuit board 30.

Specifically, the holder 50A is made of a metallic material as a whole, and includes a cylindrical section 51 into which a rear end side of the microphone unit 40 is fitted and a D-cut section 52 in which a part of a circumferential surface and a base surface of a cylinder with a base integral with the cylindrical section 51 is cut away in parallel to a board surface of the circuit board 30.

As an example, such a holder 50A can easily be obtained by providing a metallic cylinder with a base, leaving a cylindrical portion on the open side intact to use as the cylindrical section 51, cutting away the portion on the base side from a circumferential surface to a base surface by milling or the like in parallel to a board surface of the circuit board 30 to use as the D-cut section 52.

As shown in FIG. 2, the cylindrical section 51 is partially mounted in the opening 32 of the circuit board 30 with the microphone unit 40 fitted and held therein, while an axial cut plane (cutaway plane) 52*a* of the D-cut section 52 comes in substantially tight contact with the peripheral area of the opening 32 of the circuit board 30.

Therefore, the inside of the D-cut section 52 is an isolated space from the upper surface 30*a* side of the circuit board 30, and routing the lead wires 43, 43 within the D-cut section 52 will provide sufficient electrostatic shielding on the lead wires 43, 43.

In order to provide more effective electrostatic shielding on the lead wires 43, 43, the cut plane 52*a* of the D-cut section 52 is preferably soldered to the shield pattern 34 formed on the circuit board 30.

In addition, through holes 33, 33 may be drilled in the portion of the circuit board 30 covered by the D-cut section 52. The lead wires 43, 43 may be inserted through the through holes 33, 33 and ends of the lead wires 43, 43 may each be soldered to a predetermined pattern of the sound signal output part 31 on the underside of the circuit board 30.

In addition, an uncoated solder plated wire, in particular a tin plated wire, is preferably used for the lead wires 43, 43. With a tin plated wire, it is easier to provide uniform wiring shapes. Therefore, even if a noise is generated, the frequency that undergoes interference can be invariable, making it easy to address the noise in the design, such as using a ferrite bead depending on the frequency.

To further improve electrostatic shielding in the inner space, conductors such as a conductive cloth or a conductive gasket may be inserted between contact surfaces of the cover 20 and the base plate 10.

The invention claimed is:

1. A boundary microphone comprising:

a base plate having a flat base surface and a recess, the base plate being flat and made of a metallic material;

a cover having a number of sound wave through holes, the cover closing an upper surface of the base plate;

a circuit board having a sound signal output part provided on an underside thereof to face the recess, a shield pattern formed on an upper surface thereof for electrostatically shielding inside of the recess of the base plate, and an opening in a part thereof, the circuit board being mounted on the base plate so as to cover the recess;

a microphone unit having a lead wire and an output terminal electrically connected to the sound signal output part through the lead wire, the microphone unit being mounted in the opening; and a metallic holder comprising a cylindrical section into which the microphone unit is fitted, and a D-cut section having a semi-cylindrical part extending from the cylindrical section, a bottom plate to cover an end of the semi-cylindrical part and a lower opening, the lower opening being covered by the circuit board to form a space for shielding the lead wire therein; the D-cut section extending from the cylindrical section in a direction parallel to a board surface of the circuit board, wherein the space is defined by the D-cut section, the circuit board and the microphone unit, and the lead wire is located in the space, and wherein only the cylindrical section of the holder is fitted in the opening, and the D-cut section extends toward the sound signal output part to cover a part of the circuit board.

2. The boundary microphone according to claim 1, wherein the circuit board includes a ground pattern thereon, and the D-cut section is soldered to the ground pattern.

3. The boundary microphone according to claim 1, wherein an uncoated solder plated wire is used for the lead wire.

4. A boundary microphone comprising:

a base plate having a flat base surface and a recess for mounting a wiring board formed on an upper surface, the base plate being flat and made of a metallic material;

a cover having a number of sound wave through holes, the cover closing an upper surface side of the base plate;

a circuit board mounted on the base plate so as to cover the recess, the circuit board having, in a part of the circuit board, an opening for mounting a microphone unit; and a microphone unit mounted in the opening with a metallic holder, wherein a sound signal output part is provided on an underside of the circuit board that faces the recess, a shield pattern for electrostatically shielding inside of the recess with the base plate is formed on an upper surface side of the circuit board, and an output terminal of the microphone unit is electrically connected to the sound signal output part through a lead wire, wherein the holder comprises a cylindrical section into which a rear end side of the microphone unit is fitted, and a D-cut section in which a part of a circumferential surface and a base surface of a cylinder with a base integral with the cylindrical section is cut away in parallel to a board surface of the circuit board, and the lead wire is routed within the D-cut section, wherein the lead wire is drawn to the underside of the circuit board through a through hole and soldered to the sound signal output part, and wherein only the cylindrical section of the holder is fitted in the opening, and the D-cut section extends toward the sound signal output part to cover a part of the circuit board.

5. The boundary microphone according to claim 1, wherein the bottom is located at a side opposite to the cylindrical section.

* * * * *